US005283498A

United States Patent [19]

von Arx et al.

[11] Patent Number: 5,283,498

[45] Date of Patent: * Feb. 1, 1994

[54] HIGH-POWER RADIATOR

[75] Inventors: Christoph von Arx, Olten; Stefan Stutz, Fislisbach, both of Switzerland

[73] Assignee: Heraeus Noblelight GmbH, Kleinostheim, Fed. Rep. of Germany

[ * ] Notice: The portion of the term of this patent subsequent to Apr. 9, 2008 has been disclaimed.

[21] Appl. No.: 770,408

[22] Filed: Oct. 3, 1991

[30] Foreign Application Priority Data

Oct. 22, 1990 [EP] European Pat. Off. ..... 90120261

[51] Int. Cl.[5] ..... H01J 17/04

[52] U.S. Cl. ..... 313/17; 313/34; 313/40; 313/44; 313/234; 313/573; 313/607; 313/631; 313/634

[58] Field of Search ..... 313/17, 25, 26, 28, 313/34, 39, 44, 46, 231.41, 231.71, 325, 634, 607, 573, 40, 234, 631

[56] References Cited

U.S. PATENT DOCUMENTS 4,837,484 6/1989 Eliasson et al. ..... 313/231.71 X
4,983,881 1/1991 Eliasson et al. ..... 313/607
5,006,758 4/1991 Gellert et al. ..... 313/634
5,013,959 5/1991 Kogelschatz ..... 313/607 X
5,049,777 9/1991 Mechtersheimer ..... 313/634 X

FOREIGN PATENT DOCUMENTS 0363832 4/1990 European Pat. Off. .
0385205 9/1990 European Pat. Off. .

OTHER PUBLICATIONS

Gesellschaft Deutscher Chemiker, Fachgruppe Photochemie 10. Vortragstagung, Nov. 18-20, 1987, pp. 1-3, U. Kogelschatz, et al., "Neue UV- und Vuv--Excimerstrahler" (New UV and VUV Excimer Radiators).

*Primary Examiner*—Donald J. Yusko
*Assistant Examiner*—Ashok Patel
*Attorney, Agent, or Firm*—Oblon, Spivak, McClelland, Maier & Neustadt

[57] ABSTRACT

In a UV high-power radiator, a plurality of dielectric tubes (6) having internal electrodes (7) are disposed in the interior of a quartz housing having rectangular cross section. The interior of the housing is filled with a filling gas which emits UV radiation under discharge conditions. The electrical supply is provided in such a way that the discharges (17) develop between adjacent dielectric tubes (6). A notable feature of this construction is its compactness, economical nature and service friendliness.

17 Claims, 5 Drawing Sheets

HIGH-POWER RADIATOR

BACKGROUND OF THE INVENTION

1. Field of the Invention

The invention relates to a high-power radiator, in particular for ultraviolet light, having a discharge chamber filled with a filling gas which emits radiation under discharge conditions and having electrodes which are connected in pairs to one or more high-voltage sources, there being situated between two electrodes which are at different potential dielectric material which is adjacent to the discharge chamber.

At the same time the invention makes reference to a prior art as disclosed, for instance, by the European Patent Application having publication number 0 363 832.

2. Discussion of Background

The industrial use of photochemical processes is heavily dependent on the availability of suitable UV sources. The conventional UV radiators yield low to medium UV intensities at a few discrete wavelengths such as, for example, the mercury low-pressure lamps at 185 nm and, in particular, at 254 nm. Truly high UV powers are achieved only from high-pressure lamps (Xe, Hg) which, however, then distribute their radiation over a larger wavelength range. The new excimer lasers have made a few new wavelengths available for fundamental photochemical experiments, but are at present suitable only in exceptional cases for an industrial process for cost reasons.

The European Patent Application mentioned at the outset or, alternatively, the conference paper entitled "New UV and VUV Excimer Radiators" by U. Kogelschatz and B. Eliasson distributed at the 10th Lecture Conference of the Society of German Chemists, Specialist Group on Photochemistry, in Würzburg (FRG), 18th-20th Nov. 1987, describes a new excimer radiator. This new radiator type is based on the principle that excimer radiation can be produced even in dark electrical discharges, a type of discharge which is used on a large scale industrially in the production of ozone. In the current filaments of this discharge which are present only for a short time (<1 microsecond), noble gas atoms which react further to form excited molecular complexes (excimers) are excited by electron collisions. These excimers live only a few nanoseconds and, on decomposing, give up their bonding energy in the form of radiation whose wavelength range may be in the UV-A, UV-B, UV-C or even in the visible spectral range, depending on the composition of the filling gas.

In the most recent past, the demand for such high-power radiators has increased because the particular properties of the radiator have opened up many new fields of application in chemical and physical process technology, in the graphical trade, for coatings etc. There is therefore a great need for economical and operationally reliable UV radiators, if possible of modular construction.

SUMMARY OF THE INVENTION

Starting from the prior art, the object of the invention is to provide a high-power radiator, in particular for UV or VUV light, which is economical to produce because of its modular construction and makes possible the construction of very large panel-type radiators.

To achieve this object in a high-power radiator of the generic type mentioned at the outset, the invention provides that the discharge chamber is outwardly bounded by a housing which is transparent to the radiation produced, in which housing dielectric tubes spaced from one another and from the transparent housing and having inner electrodes are disposed.

When a sufficiently high alternating voltage is applied, a multiplicity of partial discharges from an electrode through the dielectric and the adjacent discharge chamber and into the dielectric again to the adjacent electrode is formed. These discharges radiate the usable UV light which then passes through the housing wall or housing walls. Here, in contrast to the known configurations, the entire extent of the discharge channels is utilized for the production of radiation.

The production of the high-power radiator according to the invention is simpler and more inexpensive than in the case of the known radiators. For example, commercial quartz housing sections can be used which exist in many dimensions. Very high demands do not have to be imposed even on the bounding glass/quartz material since the bounding walls only have to be transparent to the usable radiation and are not stressed by the discharge. This results in a long service life of the radiator. The gap width and its tolerances are also much less critical. In particular, because of the low requirements relating to tolerances, very large panel-tyoleradiators can now be produced which can be of very thin construction. Because virtually the entire length of the discharge chamber contributes to emission, the UV yield is very high. Transmission losses of an electrode grid or a partially transparent layer do not occur.

In contrast to the known radiator, in the arrangement according to the invention the dielectrics can be optimized for the UV radiation to be produced because they do not have to be transparent to the UV light, and this makes it possible to expect particularly high efficiencies for particular applications. Such applications with increasing economic importance include, for example, the use as a strong UV radiator for purposes of pre-ionizing other discharges, for example lasers, treatment of surfaces by means of exposure to UV light, chemical processes such as the preparation of new chemicals or surfaces, and coating processes such as UV-aided CVD or plasma CVD (chemical vapor deposition), and photo CVD in which a substrate to be treated is brought as close as possible to a UV light source in a suitable filling gas.

The invention is explained in greater detail below with reference to exemplary embodiments.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
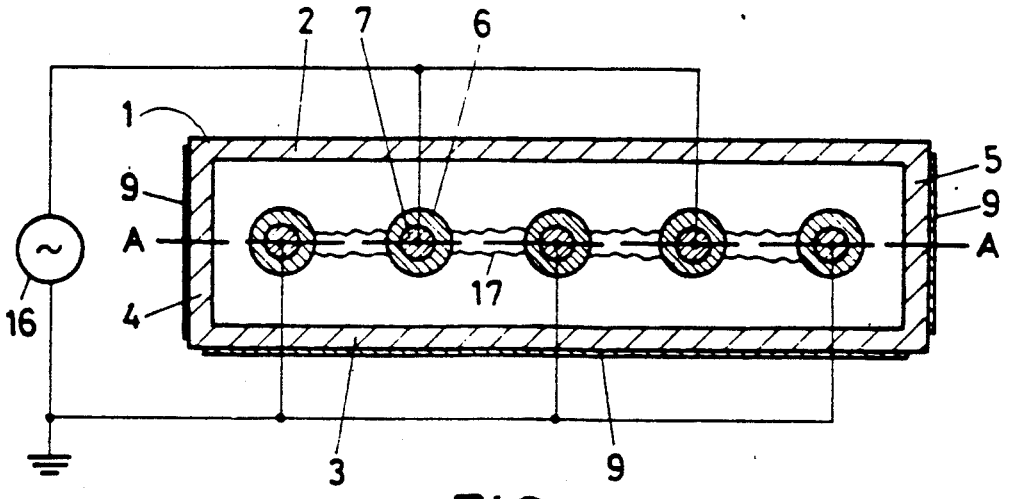
FIG. 1 shows a first exemplary embodiment of a panel-type radiator having one-sided radiation, in cross section.
Figure 2:
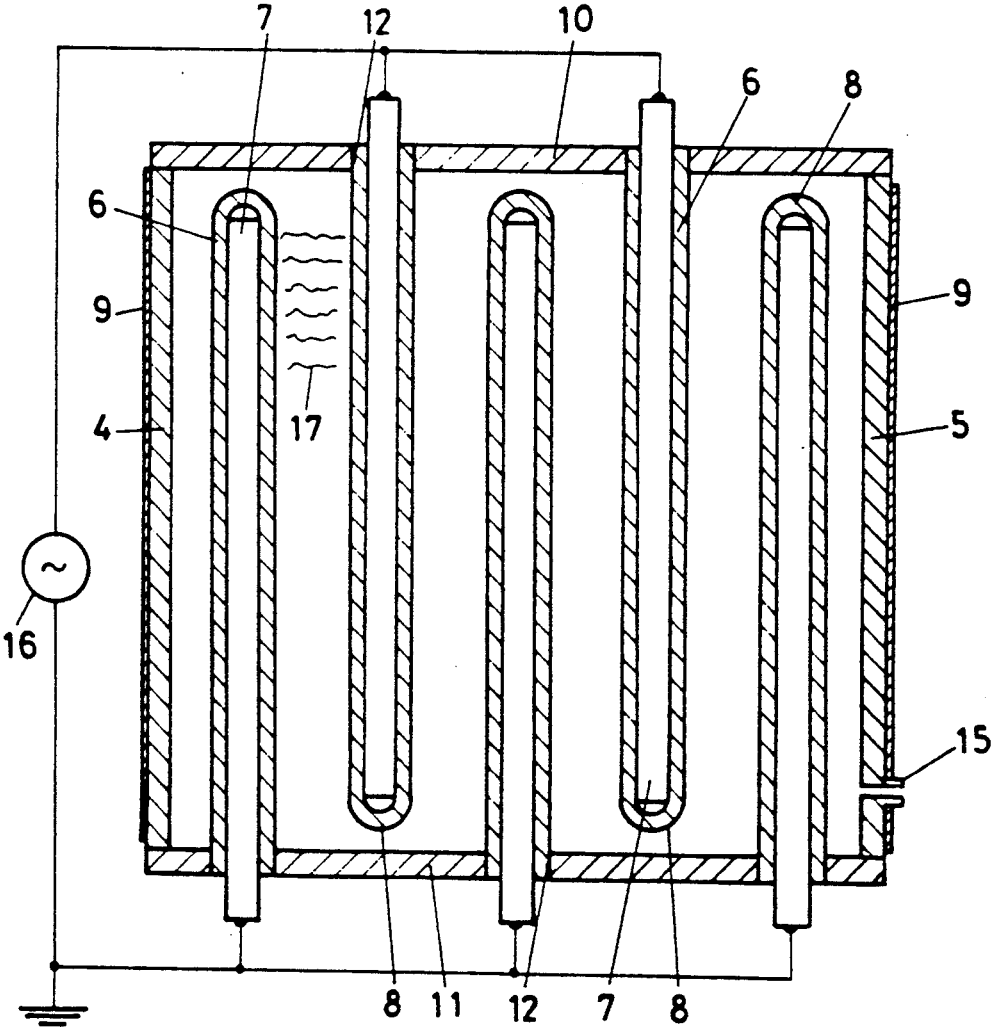
FIG. 2 shows a longitudinal section through the panel-type radiator according to FIG. 1 along line AA thereof with a diagrammatic representation of the electrical power supply.
Figure 5:
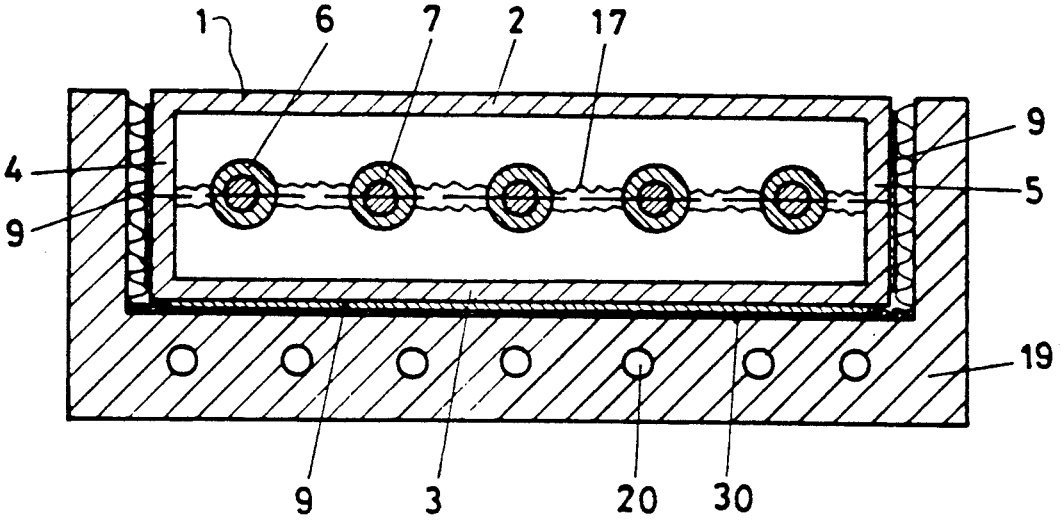
FIG. 5 shows a panel-type radiator in accordance with FIGS. 1 and 2 having external cooling.

Referring now to the drawings, wherein like reference numerals designate identical or corresponding parts throughout the several views, in the panel-type radiator according to FIGS. 1 and 2, 5 dielectric tubes 6 having internal electrodes 7 are disposed in a quartz housing 1 having the wide sides 2, 3 and the narrow sides 4, 5. The dielectric tubes 6 are spaced apart from one another and also from the walls of the quartz housing 1. The dielectric tubes 6 are, for example, narrow quartz tubes whose inner end 8 is sealed off, i.e. closed (cf. FIG. 2). The internal electrode 7 is a metal rod which is pushed into the narrow quartz tube. Instead of this, a metal rod or metal wire encapsulated in dielectric material can be used.

The two narrow sides 4, 5 and one of the wide sides 3 of the quartz housing are outwardly each provided with an aluminum coating 9. The three coatings may be—but do not have to be—electrically insulated from one another. The aluminum coating 9 is preferably vapor-deposited, flame-sprayed, plasma-jet-sprayed or sputtered and acts as reflector.

Figure 6:
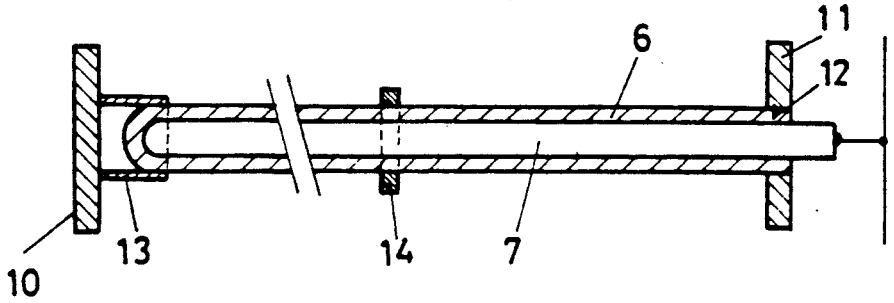
FIG. 6 shows a possibility for supporting the dielectric tubes in the case of elongated radiators.

As can be seen from FIG. 2, the quartz housing 1 is closed at its two end faces by plates 10, 11 of insulating material. These plates are, for example, cemented onto the end faces or, in the case of quartz or glass plates, fused to the said end walls. The plates 10, 11 are provided with perforations 12 into which the dielectric tubes alternately pushed from both sides of the quartz housing 1 and secured and sealed therein. At the ends situated opposite the mounting positions, the dielectric tubes are sealed off or cemented. In the case of elongated radiators, the dielectric tubes 6 are held at the free end 8 in tubular supporting elements 13 into which said ends 8 are inserted. Optionally, additional supports 14 can also be provided in the center of the tube (cf. FIG. 6). The interior chamber of the quartz tube 1 can be evacuated and then filled with a filling gas via a filling nozzle 15.

As can be seen from FIG. 2, the electrical power supply to the radiator takes place from an alternating current source 16 in a manner such that alternately adjacent internal electrodes 7 are connected to the alternating current source 16. As is further explained in greater detail later (with reference to FIG. 9), a plurality of alternating current sources may also be used. The discharges 17 then develop in the gap between every two adjacent dielectric tubes 6.

The alternating current source 16 corresponds in principle to those which are used to supply ozone generators. Typically they supply an adjustable alternating voltage in the order of magnitude of several 100 volts to 20,000 volts at frequencies in the range of the mains alternating current up to a few MHz, depending on the electrode geometry, pressure in the discharge chamber and composition of the filling gas.

The interior of the quartz housing 1 is filled with a filling gas which emits radiation under discharge conditions, for example mercury, noble gas, noble gas/metal vapor mixture, noble gas/halogen mixture, optionally using an additional further noble gas, preferably Ar, He, Ne as filler gas.

In this connection, depending on the desired spectral composition of the radiation, a substance/substance mixture in accordance with the table below may be used:

| Filling gas | Radiation |
|---|---|
| Helium | 60–100 nm |
| Neon | 80–90 nm |
| Argon | 107–165 nm |
| Argon + fluorine | 180–200 nm |
| Argon + chlorine | 165–190 nm, 250–270 nm |
| Argon + krypton + chlorine | 165–190 nm, 200–240 nm |
| Xenon | 120–190 nm |
| Nitrogen | 337–415 nm |
| Krypton | 124 nm, 140–160 nm |
| Krypton + fluorine | 240–255 nm |
| Krypton + chlorine | 200–240 nm, 460–600 nm |
| Mercury | 185 nm, 254 nm, 295–315 nm 365 nm, 366 nm |
| Selenium | 196, 204, 206 nm |
| Deuterium | 150–250 nm |
| Xenon + fluorine | 340–360 nm, 400–550 nm |
| Xenon + chlorine | 300–320 nm |

In addition, a whole series of further filling gases is suitable:

- a noble gas (Ar, He, Kr, Ne, Xe) or Hg with a gas or a vapor consisting of $F_2$, $I_2$, $Br_2$, $Cl_2$ or a compound which splits off one or more atoms of F, I, Br or Cl in the discharge;
- a noble gas (Ar, He, Kr, Ne, Xe) or Hg with $O_2$ or a compound which splits off one or more O atoms in the discharge;
- a noble gas (Ar, He, Kr, Ne, Xe) with Hg.

In the electrical partial discharge (micro-discharge) which forms, the electron energy distribution can be optimally adjusted by the wall thickness of the dielectric tubes 6 and their dielectric properties, the spacing between the dielectric tubes 6, the pressure and/or the temperature of the filling gas.

When a voltage is applied between each two adjacent electrodes, a multiplicity of discharge channels 17 develops which radiate the UV light which then passes outwards through the transparent wide side 2 of the quartz housing 1.

Wide sides 2, 3.

Figure 3:
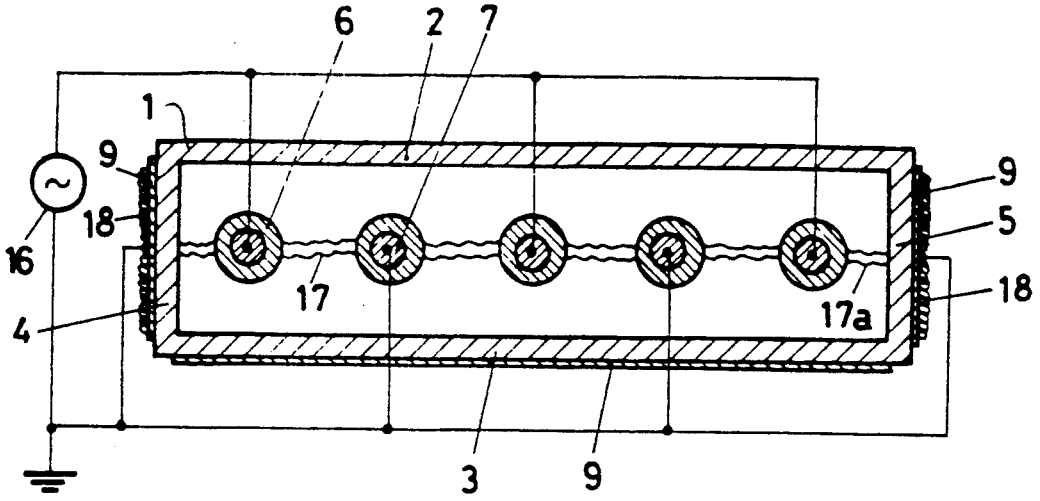
FIG. 3 shows a first modification of the panel-type radiator according to FIGS. 1 and 2 having external electrodes which are disposed on the narrow sides of the outer tube and having an electrical power supply with a voltage source grounded on one side.

As is shown in FIG. 3, the metallic reflector coatings 9 on the narrow sides of the quartz housing 1 can also be used as external electrodes. The electrical contact can be made in this case by stranded strip conductors 18 or sprung contact strips. In this connection, it is expedient to provide an uneven number of dielectric tubes 6 so that both external electrodes can ultimately be at the same potential, in the case of the example at ground potential. Discharges 17*a* then also develop between the outermost dielectric, tubes 6 and the narrow sides 4, 5 of the quartz housing 1.

Figure 4:
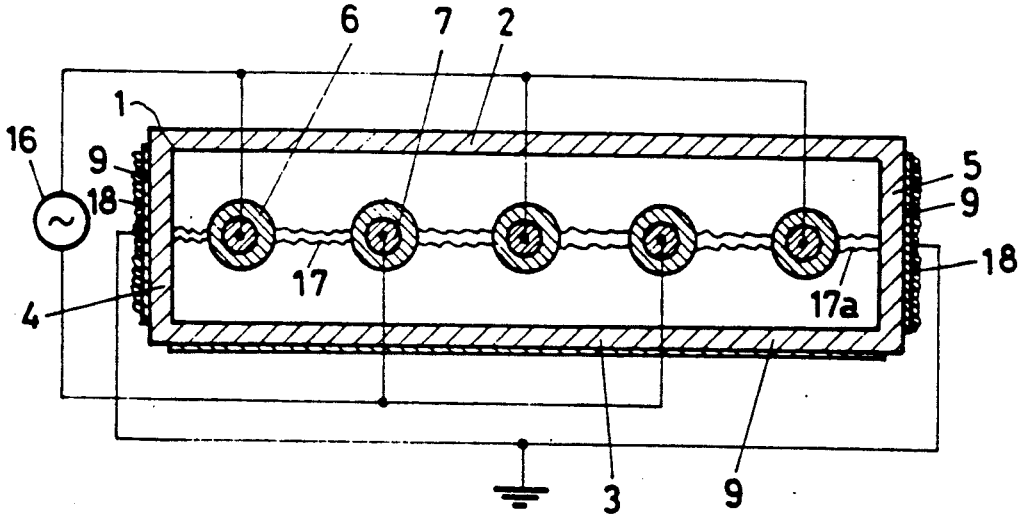
FIG. 4 shows a second modification of the panel-type radiator according to FIGS. 1 and 2 having external electrodes which are disposed on the narrow sides of the outer tube and a balanced-to-ground electrical power supply.

Because, in the case of power supply devices having balanced-to-ground output, the insulation loadings of the components used in that case is lower than in the case of those with single-sided supply, such devices are more economical. FIG. 4 shows the supply of power to a radiator according to FIG. 3 with a power supply device having balanced-to-ground output. The full output voltage of the alternating current source 16 is applied between each of the adjacent internal electrodes 7, whereas half the output voltage is applied between the internal electrodes 7 of the outer dielectric tubes 6 and the external electrodes 9. Accordingly, the spacing between the dielectric tubes 6 is also larger than the spacing between the two outer dielectric tubes 6 from the narrow sides 4,5 of the quartz housing 1.

Because of their new geometry, high-power radiators of the type described can be cooled very simply. As FIG. 5 shows, the quartz housing 1 can be laid in a suitably dimensioned metal section 19 having U-shaped cross section, for example made of aluminum or copper, having coolant bores 20 extending, for example, in the longitudinal direction of the section contained therein.

Inserted between the limbs of, the U section and the narrow sides 4, 5 of the quartz housing 1 is a sprung metallic contact strip 21 which extends over the entire tube length. In addition to making electrical contact to the coating 9, it also serves to secure the quartz housing 1 in the space between the limbs of the metal section 19. Optionally, an interlayer of heat-conducting paste 30 can be provided between the bottom of the section and the quart housing 1 in order to improve the heat transfer. The electrical power supply takes placed analogously to FIG. 4, i.e. the metal section 19 is at ground potential. Of course, the electrical power supply can also take place as is shown in FIG. 2 or 3.

The embodiments of the invention described above have a number of advantages which are summarized as follows:

- commercial quartz sections which are available in many dimensions and a notable feature of which is high mechanical load-carrying capacity can be used for the quartz housing 1;
- simple expansion of existing irradiation devices by the modular construction possible with the invention;
- the electrodes (which are at high-voltage potential), together with their terminal fittings, can be designed for contact safety with simple means;
- the use of power supply devices with balanced-to-ground output voltage makes possible economical power supply;
- the use of a plurality of power supply units which are independent of one another is possible;
- a wire net, wire grid or a transparent external electrode is unnecessary, which facilitates cleaning of the radiator, for example when used in the graphical trade;
- the quartz parts of the radiator, which are responsible for the transmission of the UV light are not stressed by discharge attack;
- the aluminum vapor deposition makes a large part of the radiation produced usable;
- the entire device, including cooling, can be designed to be extremely flat and, in its areal extension, virtually as large as desired and it is therefore suitable for very many technical applications.

Without departing from the scope set by the invention, a wealth of modifications of the UV high-power radiator described above are possible and these will be dealt with below.

Thus, instead of an odd number of quartz tubes 6 for configurations in accordance with FIGS. 2, 3 and 4, even variants can also be provided.

Figure 7:
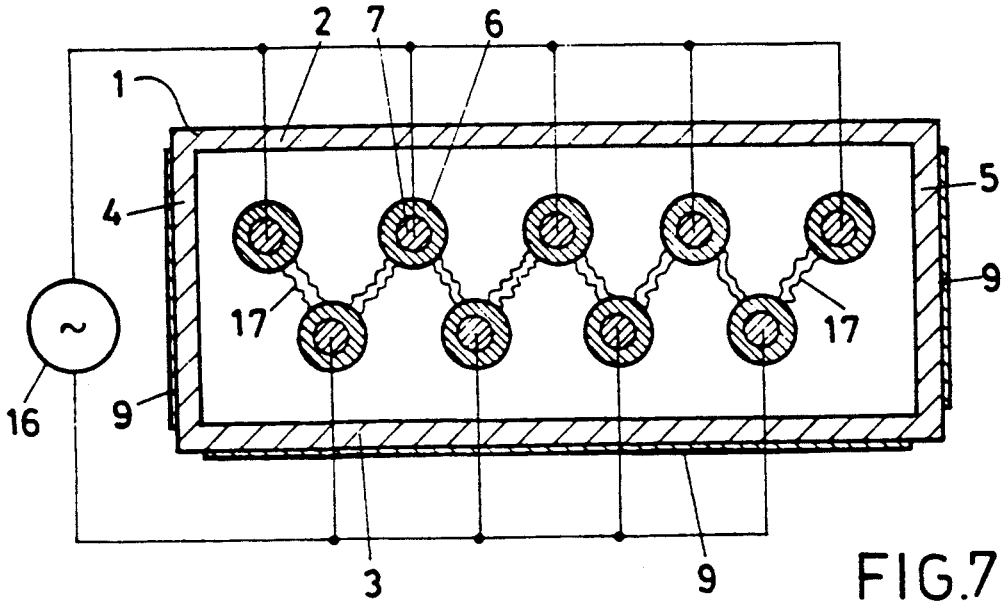
FIG. 7 shows an alternative to the configurations hitherto having more than one layer of dielectric tubes in the interior of a quartz housing.

Instead, of a single layer of dielectric tubes 6 in a quartz housing 1, two or more layers may be provided as is illustrated in FIG. 7. The dielectric tubes 6 of one layer are offset by a half tube spacing with respect to the dielectric tubes of the adjacent layer. The dielectric tubes 6 of each layer are wired in parallel and connected to the two poles of the alternating current source 16. The discharge channels extend at an angle through the discharge chamber from one layer to the next.

Figure 9:
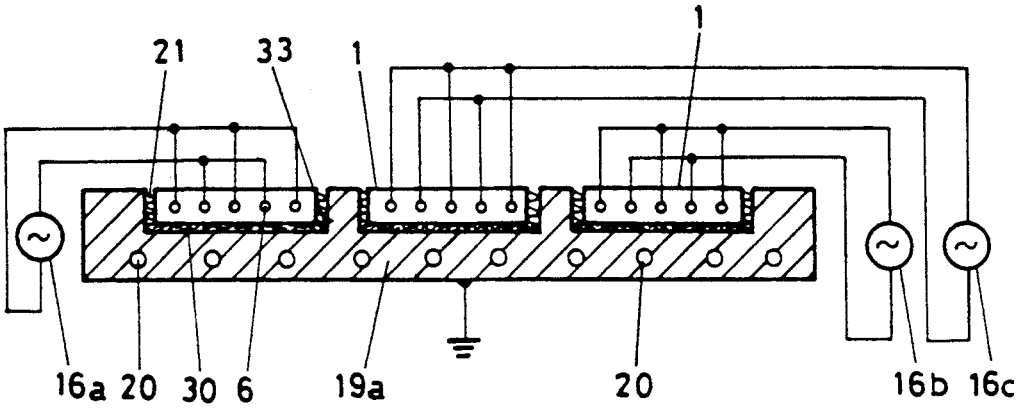
FIG. 9 shows a modification of the exemplary embodiment in accordance with FIG. 5 having a plurality of radiators in a common cooling element.

Furthermore, the invention offers the possibility of embedding a plurality of individual radiators, for example in accordance with FIG. 1 or FIG. 3, in a common cooling element, as is illustrated in FIG. 9. In that case, an aluminum or copper section 19*a* is provided with channels which extend in Example 3 in the longitudinal direction of the section and has a U-shaped cross section. Analogously to FIG. 5, there are inserted in said channels quartz housings 1 whose construction was described in detail in connection with FIG. 1, 3 or 5. The electrical supply can be carried out analogously to the previous exemplary embodiments. As a departure from this, FIG. 9 shows that the individual radiators are connected to separating alternating current sources 16*a*, 16*b*, 16*c*. These measures will be necessary if a single source is not sufficient to supply a multiplicity of radiators.

Previous embodiments of the invention all related to quart housings having rectangular cross section. It is within the scope of the invention to dispose the dielectric tubes 6 in the gap 22 between two quartz housings 23, 24 disposed coaxially one within the other. Analogously to FIG. 2 or 3, the internal electrodes 7 are alternately connected to the two terminals of the alternating current source 16, in which case, analogously to FIG. 1, the internal electrodes 7 of the first group of internal electrodes 7 are interconnected at one end surface and the internal electrodes 7 of the other group are brought together at the other end surface of the tubes 23, 24. Analogously to FIG. 2, the interior 22 is closed at both end surfaces of the quartz housings 23, 24 is in each case with an annular lid 25 which is at the same time also a support for the dielectric tubes 6.

Figure 8:
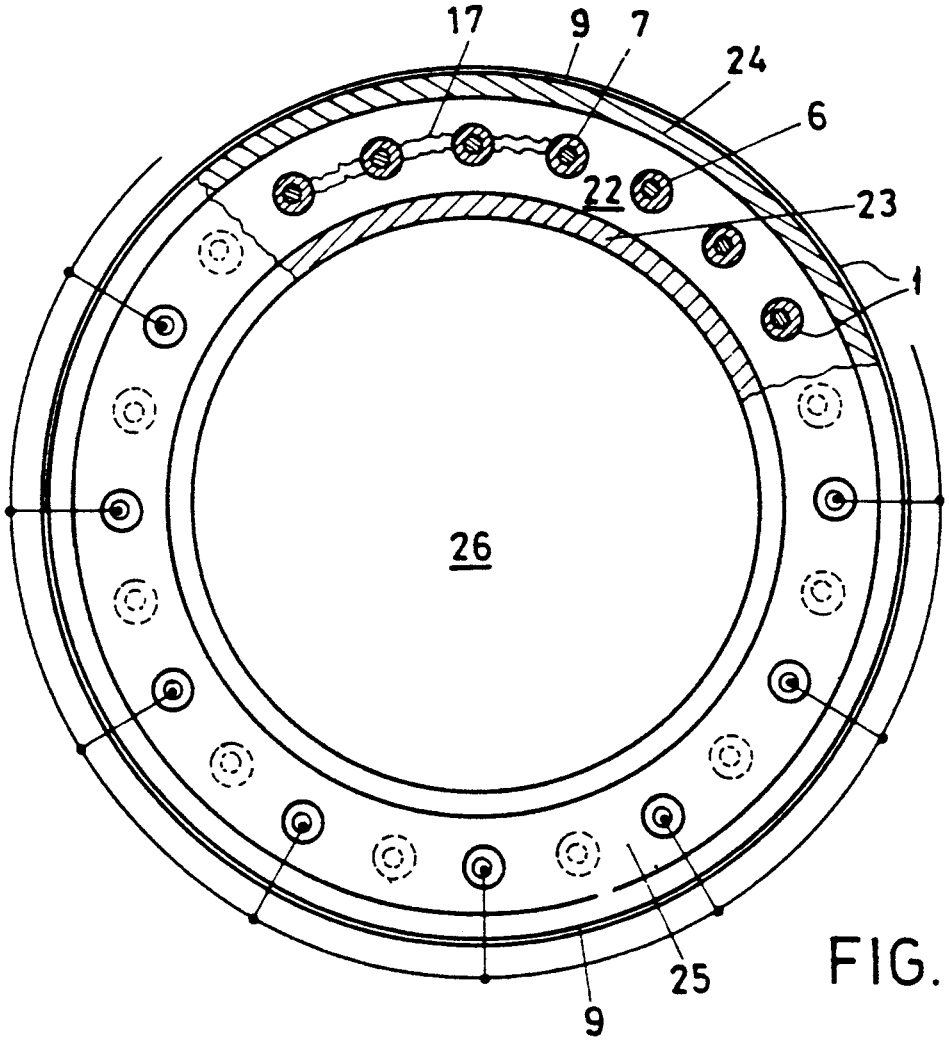
FIG. 8 shows an exemplary embodiment of the invention in the form of a cylindrical radiator, partly in cross section and partly in end view.
Figure 10:
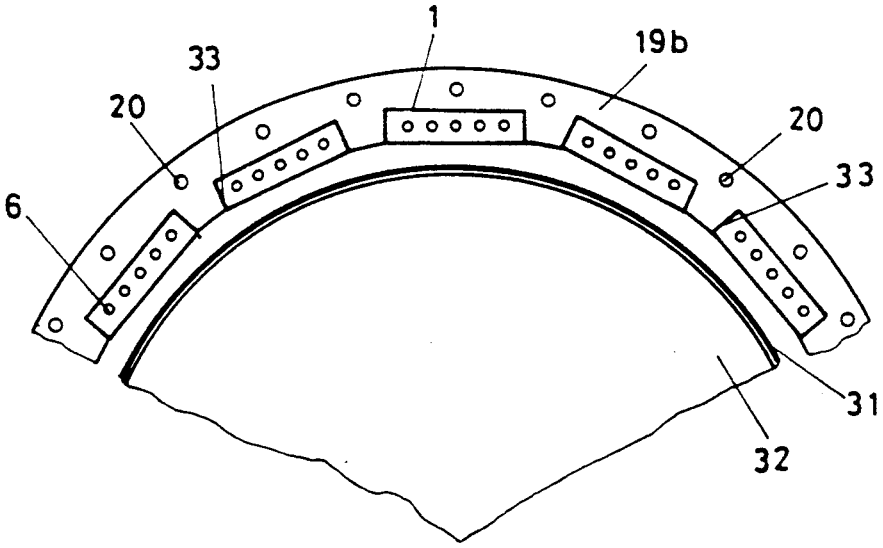
FIG. 10 shows a modification of the exemplary embodiment in accordance with FIG. 9 having a plurality of radiators on the inside of a curved cooling element.

Depending on whether the device is designed as an external or internal radiator, an aluminum coating 9 which serves as reflector has to be provided on the internal surface of the inner quartz tube 23 or on the external surface of the outer quartz tube 24, respectively. By analogy with FIG. 5, there is also the possibility in the case of a circular radiator according to FIG. 8 of forced cooling the radiator, for example by passing coolant through the interior 26 of the inner quartz tube 23 or by filling said interior 26 with a heat sink (not shown). In the case of an internal radiator, the external lateral surface of the outer quartz tube 24 can either have coolant flowing round it or an independent heat sink may be pushed over the outer quartz tube 24. In this connection, an arrangement is advantageous which is such as that shown in FIG. 10 using the example of an irradiation device for sheet-type materials such as sheets of film or paper. The material 31 to be irradiated is passed over a drum 32. The cooling element 19*b*, which is composed of a metal with good heat conduction, for example copper or aluminum, comprises a section of tube matched to the drum 32 having cooling bores 20 extending in the longitudinal direction of the tube. The inside wall of the section of tube has open channels 33 having rectangular cross section in which quartz sections into accordance with FIG. 1 or FIG. 3 are inserted and secured therein. The electrical power supply is carried out by analogy with the previous exemplary embodiments.

Instead of round dielectric tubes 6 and internal electrodes and dielectric tubes 7, electrodes with virtually any desired cross section can also be used in all the embodiments. To improve the heat dissipation from the dielectric 6 it is also possible to construct the internal electrodes 7 as hollow electrodes.

Obviously, numerous modifications and variations of the present invention are possible in the light of the above teachings. It is therefore to be understood that within the scope of the appended claims, the invention may be practiced otherwise than as specifically described herein.

What is claimed as new and desired to be secured by Letters Patent of the United States is:

1. A high power ultraviolet radiator comprising:

a housing at least partially transparent to ultraviolet light and filled with a filling gas which emits ultraviolet radiation under discharge conditions in a discharge chamber bounded by the housing;

plural dielectric tubes disposed in the housing and spaced apart from one another; and plural internal electrodes disposed in respective of said plural dielectric tubes and adapted to be connected in pairs to at least one high-voltage source so that upon application of a voltage from said at least one high-voltage source to said pairs of internal electrodes a dark electric discharge develops in the discharge chamber of the housing.

2. The high-power radiation as claimed in claim 1, wherein the housing comprises quartz walls defining a rectangular cross section and the internal electrodes being connected to respective poles of the at least one high-voltage source.

3. The high-power radiation as claimed in claim 1, wherein the housing comprises quartz walls defining a rectangular cross section and the internal electrodes are disposed in a plurality of planes, all the internal electrodes of each plane of internal electrodes being wired in parallel and being connected to a respective pole of the at least one high-voltage source.

4. The high-power radiation as claimed in claim 1, wherein the housing comprises two housing tubes lying coaxially one inside the other and the dielectric tubes are disposed in an annular discharge chamber between said housing tubes.

5. The high-power radiation as claimed in claim 2 or 3, wherein the housing comprises opposed end plates disposed at opposed ends of said quartz walls to close said housing, said end plates serving as a support for at least one end of at least one of the dielectric tubes.

6. The high-power radiation as claimed in claim 5, comprising:

at least one supporting element mounted on at least one of said plates for supporting an end of at least one of the dielectric tubes.

7. The high-power radiation as claimed in claim 5, comprising:

at least one center supporting element mounted on the housing for supporting at least one of the dielectric tubes in a central portion of said at least one of said dielectric tubes.

8. The high-power radiation as claimed in claim 5, comprising:

a reflecting coating provided on three of the four walls of the housing.

9. The high-power radiation as claimed in claim 3, wherein said reflecting coating comprises:

a vapor-deposited aluminum coating.

10. The high-power radiation as claimed in claim 4, comprising:

a reflecting coating provided on an inner surface of the inner tube.

11. The high-power radiation as claimed in claim 10, wherein said reflecting coating comprises:

a vapor-deposited aluminum coating.

12. The high-power radiation as claimed in claim 4, comprising:

a reflecting coating provided on an external surface of the outer tube.

13. The high-power radiation as claimed in claim 12, wherein said reflecting coating comprises:

a vapor-deposited aluminum coating.

14. The high-power radiation as claimed in claim 1,2, 3 or 4, further comprising:

a heat sink at least partially surrounding said housing.

15. The high-power radiation as claimed in claim 14, wherein said housing is disposed in said heat sink.

16. The high-power radiation as claimed in claim 14, wherein said heat sink comprises a body having at least one open channel into which said housing is inserted and held therein.

17. The high-power radiation as claimed in claim 14, wherein said heat sink comprises a body having plural open channels into which a respective housing is inserted and held therein.

* * * * *